US006286702B1

(12) United States Patent
Buermann

(10) Patent No.: US 6,286,702 B1
(45) Date of Patent: Sep. 11, 2001

(54) PRESSURE RELEASE SAFETY CAP

(76) Inventor: Henry Buermann, R.R. 1, East Hill, Brookfield, VT (US) 05036

( * ) Notice: Subject to any disclaimer, the term of this patent is extended or adjusted under 35 U.S.C. 154(b) by 0 days.

(21) Appl. No.: 09/441,383

(22) Filed: Nov. 16, 1999

(51) Int. Cl.[7] ..... B65D 51/16

(52) U.S. Cl. ..... 220/229; 220/231; 220/266; 220/89.2; 215/253; 222/153.06

(58) Field of Search ..... 220/231, 266, 220/270, 229, 89.1, 89.2, 915, 724, 203.08; 215/251, 254, 260, 262, 253; 222/153.06, 153.07, 153.1, 397, 541.1

(56) References Cited

U.S. PATENT DOCUMENTS 3,292,826 * 12/1966 Abplanalp ..... 220/89.2
3,684,124 * 8/1972 Song ..... 222/153.07 X
3,826,412 * 7/1974 Kneusel ..... 222/397
3,831,822 * 8/1974 Zundel ..... 220/89.2 X
4,576,303 * 3/1986 Mundt et al. ..... 220/89.2 X
5,197,622 * 3/1993 Anderson ..... 220/89.2
5,411,158 * 5/1995 Kays et al. ..... 220/89.2
5,544,779 * 8/1996 Yamamoto et al. ..... 220/89.2
5,570,803 * 11/1996 Farwell ..... 220/89.2
5,632,393 * 5/1997 Houser ..... 220/915 X

* cited by examiner

*Primary Examiner*—Nathan J. Newhouse
(74) *Attorney, Agent, or Firm*—Kevin Ellicott, Esq

(57) ABSTRACT

A pressure release safety cap comprising a pressure release safety cap body having an open end and a closed end, the closed end having located thereupon a frangible groove and a hinge groove.

9 Claims, 4 Drawing Sheets

PRESSURE RELEASE SAFETY CAP

CROSS REFERENCE TO OTHER APPLICATIONS

This is the first submission of an application for this article of manufacture. There are no other applications, provisional or non provisional.

FEDERALLY SPONSORED RESEARCH AND DEVELOPMENT

There are no federally sponsored or funded research or development projects or undertakings in any way associated with the instant invention.

BACKGROUND OF THE INVENTION

1. Field of the Invention

The instant invention relates to that field of devices consisting of articles of manufacture known as safety caps. Specifically, the instant invention is a compressed gas bottle high pressure release cap.

2. Background Information

The prior art known to applicant discloses that single use safety caps are reasonably well known. The single use safety cap is most often intended to prevent unwanted intrusion of foreign matter into the area protected by the cap, or to provide quick visual indication as to whether or not the area protected by the cap has been tampered with. These safety caps have been utilized in conjunction with a great number of different containers, the containers holding diverse materials. Applicant is aware of tamperproof and tamper evident safety caps intended to be used with various liquids stored in pressurized containers. For example, in Tamperproof Container Closure issued to J. W. Soffer, U.S. Pat. No. 2,643,015, Jun. 23, 1953, the tamper proof cap is a frustoconical cap having a closed end and an open end, the open end having teeth for gripping the container to be protected, and a pull tab which permits the user to break the safety cap and remove it prior to use of the container.

Another example of tamper proof caps may be found in Tamper Indicating Cap Seal for Container Valves, issued to Charles Fuehrer, U.S. Pat. No. 4,712,705, Dec. 15, 1987, the tamper indicating cap is nearly identical to Soffer, but has been adapted for use on beverage tanks having valves or quick disconnect coupling plugs by essentially including another depending skirt to the device disclosed in Stoffer, and a series of bumps or protrusions on the interior wall which mate up with the various indentations found on the valves of common beverage tanks.

Unfortunately, none of the above prior art patents provides a safe, efficient and easy to use way to prevent intrusion into a gas cylinder valve, while at the same time providing a safe means for escape of pressurized gas.

In both Soffer '015 and Fuehrer '705, the cap is intended to remain in place once attached, and no provision is made to allow the safe escape of high pressure gas from the container. In fact, the stated objective in both of these patents is to provide a cap which cannot be removed without causing visible damage to the cap. This is a critical flaw.

Those who routinely handle pressurized gas canisters (for example, those who supply hospitals and others with so-called "oxygen bottles") know that on occasion high pressure gas may escape from the cylinder valve. Escapes such as this are rarely intended or anticipated. When such an escape of high pressure gas occurs, anything between the valve and the outside environment will be subjected to a sudden stream of high velocity gas. All too often it is the safety cap which takes the brunt of the force of the escaping gas. The result is a safety cap acting as a high velocity, and potentially highly dangerous, projectile as it is blown away from the valve.

In the event that high pressure gas escapes while the Fuehrer '705 cap is in place, the sudden high pressure release against the underside surface of the top of the cap is extremely likely to dislodge the cap and send it flying away from the container at a dangerous velocity. Soffer '015, being of the same essential construction, is just as likely to be dislodged and become a potentially dangerous missile.

SUMMARY OF THE INVENTION

The instant invention is a pressure release safety cap designed specifically for use on tanks and other containers holding pressurized contents and having valves for releasing those pressurized contents. Unlike all prior art known to Applicant, the present invention incorporates features which permit the unexpected and uncontrolled escape of high pressure materials from within the container without permitting the pressure release safety cap or fragments thereof to become dangerous projectiles.

Applicant accomplishes this objective by incorporating a pressure release means into the pressure release safety cap. When high pressure materials suddenly escape the container by passing out through the valve which the device covers, the pressure release means gives way, thus permitting the high pressure material to exit the pressure release safety cap while the cap remains in place. No prior art known to Applicant is designed to accomplish this objective.

Another objective of the instant invention is to provide a pressure release safety cap having a pressure release means which will break apart during the unexpected release of high pressure gas, and yet still remain a single unit so that pressure release means fragments do not become potentially dangerous projectiles.

Applicant accomplishes this objective by incorporating pressure release means which will break apart along predetermined weakened areas, while at the same time incorporating fragment retention means which ensure that any fragments which may be produced during the breaking apart remain attached to the pressure release safety cap.

Another objective of the present invention is to provide a pressure release safety cap which permits the escape of high pressure materials, and yet also provides a measure of safety against tampering and the unwanted intrusion of foreign matter into the container valve.

Applicant accomplishes this objective by creating a pressure release safety cap which, prior to destruction of the pressure release means, cannot be removed from the container without damaging the pressure release safety cap. Furthermore, once in place on the container's valve, Applicant's pressure release safety cap is so closely associated with the valve and container that foreign matter is prevented from entering the cap, and therefore is prevented from entering the container valve.

A DESCRIPTION OF THE DRAWINGS

A DESCRIPTION OF THE PREFERRED EMBODIMENT

Figure 1:
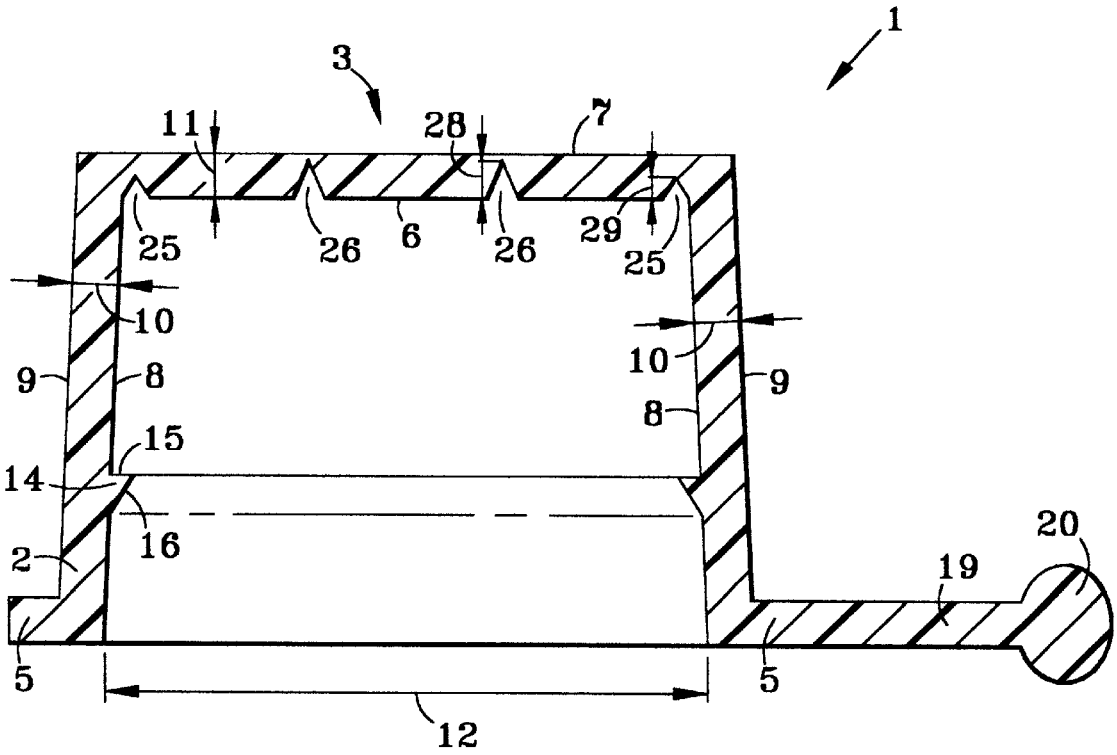
FIG. 1 is a side cross sectional view of the pressure release safety cap.
Figure 2:
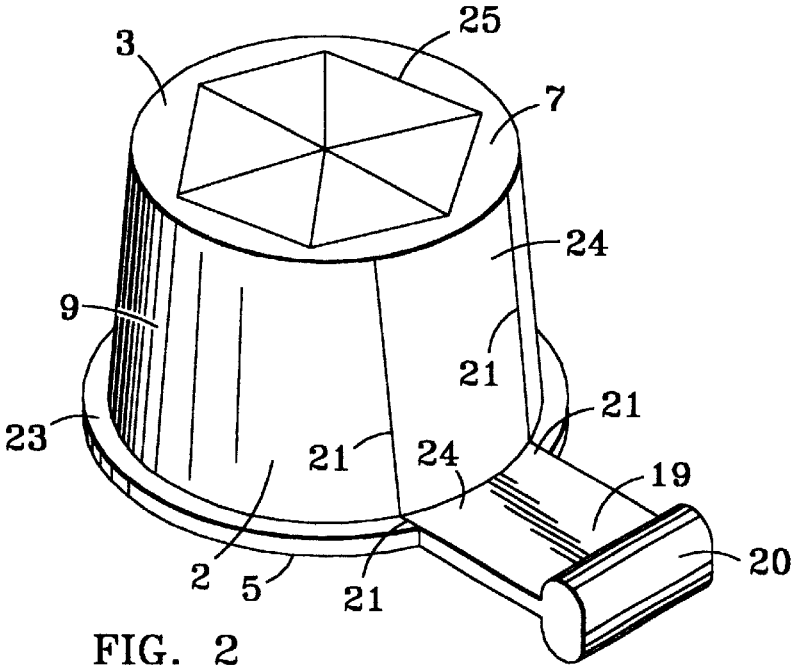
FIG. 2 is a side perspective view of the pressure release safety cap.
Figure 3:
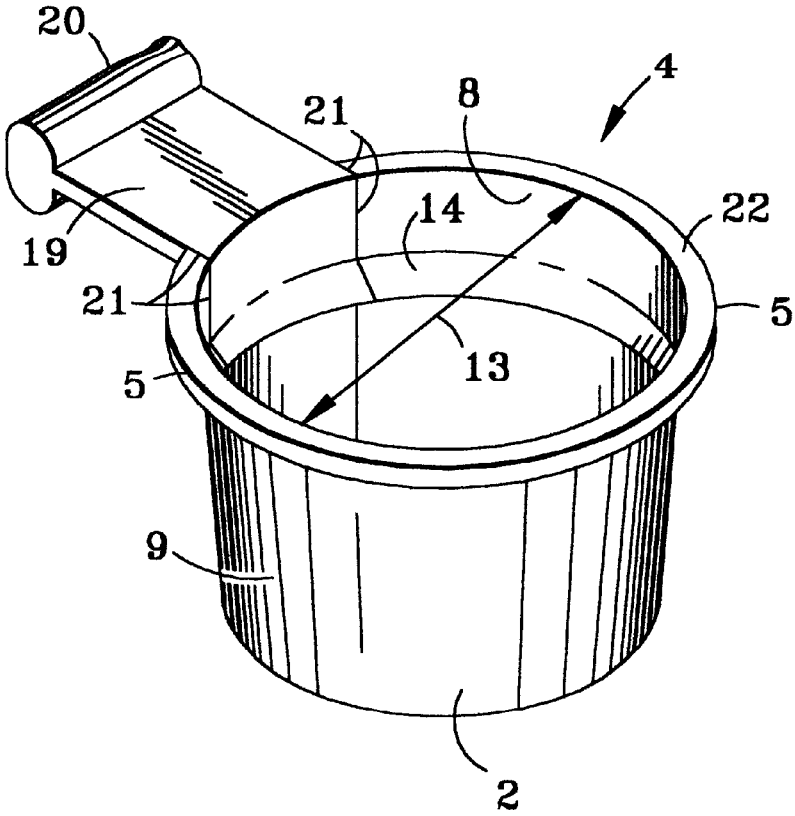
FIG. 3 is a bottom perspective view of the pressure release safety cap.

As per FIGS. 1, 2, and 3, a pressure release safety cap (1) comprises a hollow body which has an open end and a closed end, a pressure release means and a fragment retention means located on the closed end, and pressure release safety cap retention means to attach the pressure release safety cap to a high pressure valve.

In the preferred embodiment the pressure release safety cap is essentially a hollow frusto-conical body composed of a frusto-conical body wall (2), a hollow frusto-conical body closed end section (3) and a hollow frusto-conical body open end (4). A circumferential flange (5) extends outwardly from and entirely around, the frusto-conical body wall (2), proximate to the open end (4), the circumferential flange having a circumferential flange top surface (23) and a circumferential flange bottom surface (22).

As per FIGS. 1 and 2, the hollow frusto-conical body closed end section (3) has a closed end section inner surface (6) and a closed end section outer surface (7). The hollow frusto-conical body closed end section is essentially a disc connected around its entire circumference to the frusto-conical body wall (2).

As per FIG. 1, a hollow frusto-conical body closed end section thickness (11) may be described as the distance between the hollow frusto-conical body closed end section inner surface (6) and the hollow frusto-conical body closed end section outer surface (7). The hollow frusto-conical body closed end section may further be described as being horizontal.

As per FIGS. 1, 2 and 3, the frusto-conical body wall (2) has a frusto-conical body wall continues inner surface (8) and a frusto-conical body wall continuous outer surface (9). The frusto-conical body wall may further be described as being vertical and perpendicular relative to the closed end (3). In the preferred embodiment, the frusto-conical body wall continuous inner surface (8) merges into, and becomes one with, the hollow frusto-conical body closed end section inner surface (6) wherever the frusto-conical body wall inner surface (8) and the hollow frusto-conical body closed end section inner surface (6) meet. Furthermore, in the preferred embodiment, the frusto-conical body wall continuous outer surface (9) merges into, and becomes one with, the hollow frusto-conical body closed end section outer surface (7) wherever the frusto-conical body wall outer surface (9) and the hollow frusto-conical body closed end section outer surface (7) meet.

As per FIG. 1, a frusto-conical body wall thickness (10) may be described as the distance between the frusto-conical body wall continuous inner surface (8) and the frusto-conical body wall continuous outer surface (9). In the preferred embodiment, the frusto-conical body wall thickness is the same at any point along the frusto-conical body wall. The frusto-conical body wall thickness must be sufficiently thick so that when the pressure release safety cap is in place on the valve, and gas is unexpectedly released through the valve, the frusto-conical body wall will not be warped or deformed to the point where the cap may be blown off the valve. Furthermore, the frusto-conical body wall should be sufficiently thick so that the frusto-conical body wall will not be destroyed by the force of the escaping high pressure gas prior to the pressure release means giving way and venting said gas. In the preferred embodiment, the frusto-conical body wall thickness is 0.030 of one inch.

As per FIG. 1, the hollow frusto-conical body has an interior diameter (12). The hollow frusto-conical body interior diameter may be better understood as the straight line distance between a point along the frusto-conical body wall and a horizontally co-planar, but directly opposite, point along the frusto-conical body wall. As per FIG. 1, the hollow frusto-conical body interior diameter must be sufficiently large so as to permit the insertion therein of the valve which is to be covered by the cap, but not so large as to permit the intrusion of unwanted materials between the hollow frusto-conical body wall continuous inner surface and the valve. In the preferred embodiment, the hollow frusto-conical body interior diameter at the open end (4) is 0.435 of one inch.

As per FIG. 3, the pressure release safety cap has the hollow frusto-conical body open end (4). The hollow frusto-conical body open end has a hollow frusto-conical body open end diameter (13) equal to the hollow frusto-conical body interior diameter (12). The hollow frusto-conical body open end permits the insertion of a valve within the pressure release safety cap.

As was noted above, the pressure release safety cap has a pressure release safety cap retention means. The pressure release safety cap retention means serves as the means for retaining the pressure release safety cap on the valve. The pressure release safety cap retention means further prevents removal of the pressure release safety cap from the valve without damaging the pressure release safety cap (and thus provide visual evidence of tampering) as well as preventing the pressure release safety cap from dislodging from the valve during the unexpected release of compressed gas, prior to the pressure release means giving way and venting said gas.

Figure 4:
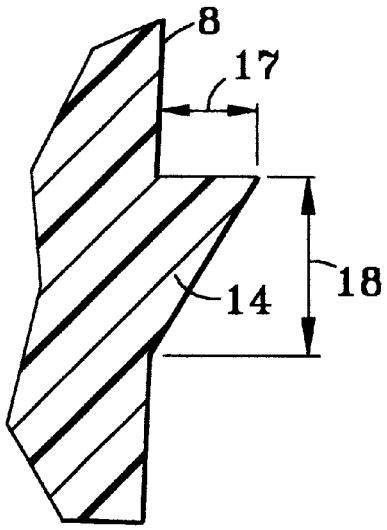
FIG. 4 is a close up cross sectional detail of the circumferential retainer ridge.

In the preferred embodiment, as per FIGS. 1, 3 and 4, Applicant utilizes a circumferential retainer ridge (14) as the pressure release safety cap attaching means. The circumferential retainer ridge is located on the hollow frusto-conical body continuous inner surface, the circumferential retainer ridge extending inwardly with respect to the axis of the hollow frusto-conical body wall.

The circumferential retainer ridge (14) may be better understood with reference to FIG. 1 wherein the circumferential retainer ridge is further described as being composed of a circumferential retainer ridge horizontal section (15), the circumferential retainer ridge horizontal section being parallel to, though not horizontally co-planar with, hollow frusto-conical body wall and parallel to, though not co-planar with, the hollow frusto-conical body closed end section (3) and a circumferential retainer ridge angled section (16), the circumferential retainer ridge angled section being at an acute angle relative to the hollow frusto-conical body wall and the hollow frusto-conical body closed end section (3).

As per FIGS. 1, 4 and 9, the circumferential retainer ridge serves as the means for firmly retaining the pressure release safety cap on the valve. The circumferential retainer ridge is of a diameter to tightly engage the threaded valve and secure the pressure release safety cap to the valve. Once in place, the circumferential retainer ridge horizontal section comes into direct contact with the valve thread, locking the pressure release safety cap onto the valve. It should be understood that circumferential retainer ridges such as the type described above are well known in the art of single use safety caps, and that various analogues such as teeth and other protrusions will work equally well so long as they interlock with the threaded valve and prevent removal of the pressure release safety cap without damaging said cap. In the preferred embodiment, the circumferential retainer ridge horizontal section has a width (17) of 0.020 of one inch. The circumferential retainer ridge angled section has a height (18) of 0.084 of one inch.

As per FIGS. 1, 2 and 3, the pressure release safety cap has a pull tab (19) extending from the circumferential flange (5). The pull tab (19) is preferably a flattened tab which is parallel to and co-planar with the circumferential flange. In the preferred embodiment, the pull tab terminates in a bulbous end (20). The bulbous end (20) serves as a finger grip, making grasping of the pull tab easier.

The pull tab serves as the means for removing the pressure release safety cap from the valve when the pressure release safety cap is no longer needed. The pull tab (19) is integral with the pressure release safety cap. In order to make removal of the pressure release safety cap possible, Applicant includes a pair of parallel weakened lines (grooves or striations) which define a pull tab strip (24). The parallel weakened lines (21) are spaced apart from one another at a distance equal to the width of the pull tab (19). The parallel weakened lines (21) extend fully across the circumferential flange, meeting the hollow frusto-conical side wall (2) and extend fully up the frusto-conical side wall, traversing the circumferential retainer ridge (14), and ending where the parallel weakened lines meet the hollow frusto-conical body closed end section (3). In the preferred embodiment, the parallel weakened lines are grooved into the circumferential flange bottom surface (22), the frusto-conical body wall continuous inner surface (8) and the circumferential retainer ridge (14). However, the parallel weakened lines could be grooved into the circumferential flange top surface (23) and the frusto-conical body wall continuous outer surface (9). It will be immediately apparent to one skilled in the pertinent art that pull tabs and parallel weakened lines defining pull tab strips such as described above are already well known in the art. Furthermore, it will be quickly recognized that the pull tab bulbous end (20) is merely included as a convenience to the user of the pressure release safety cap, and is not necessary for operation of the instant device. Clearly, one may construct the instant invention without the circumferential flange (5) in which case the pull tab (19) would be attached directly to the frusto-conical body wall continuous outer surface (9).

Figure 5:
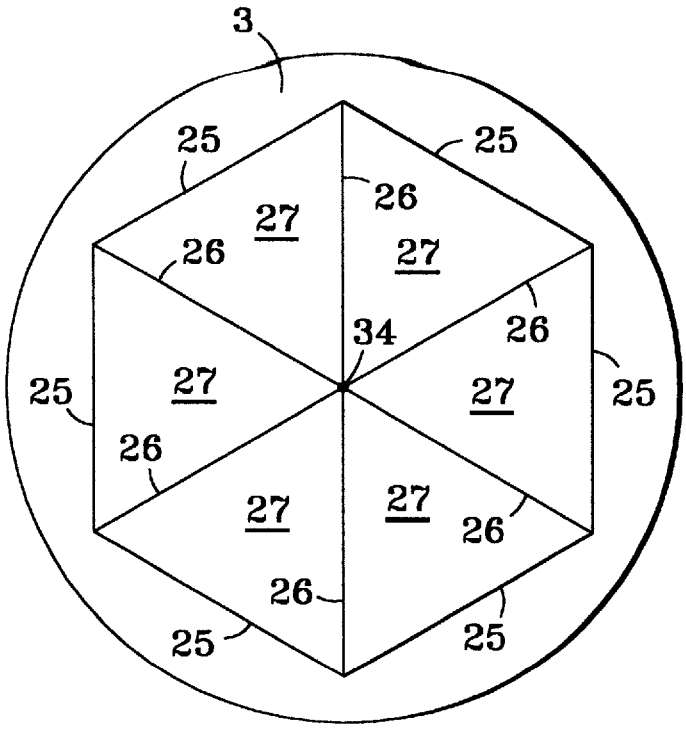
FIG. 5 is a close up top view of the pressure release safety cap hollow cylinder closed end section having the pressure release means.

As per FIGS. 1, 2 and 5, the instant invention further has the pressure release means and fragment retention means. In the preferred embodiment, the pressure release means are frangible grooves (26) located on the hollow frusto-conical body closed end section (3). The fragment retention means is a hinge groove also located on the frusto-conical body closed end section (3).

The pressure release means acts as the means for permitting the unexpected escape of high pressure material. To accomplish this objective, Applicant includes the frangible grooves (26) on the hollow frusto-conical body closed end section (3), the frangible grooves being intended to permit the hollow frusto-conical body closed end section to fragment into sections when a sufficient amount high pressure material strikes the hollow frusto-conical body closed end section inner surface (6). By designing the hollow frusto-conical body closed end section to break apart, and thereby permit the escape of high pressure material from within the pressure release safety cap, Applicant prevents the pressure release safety cap from being blown off the valve, and thereby prevents the pressure release safety cap from becoming a potentially dangerous missile.

However, Applicant further recognizes that the mere inclusion of the frangible grooves will not ensure that the hollow frusto-conical body closed end section will break apart into fragments (27) in a controlled manner. Applicant believes it would be nearly as dangerous for the hollow frusto-conical body closed end section fragments (27) to become detached from the pressure release safety cap, potentially creating numerous shrapnel like projectiles. Furthermore, if only the frangible grooves were included in the instant invention, it is entirely possible that the pressure release means might be insufficient to vent the high pressure material, and that the pressure release safety cap might still be blown free of the valve and act as a high velocity projectile.

To prevent both the uncontrolled fragmentation of the hollow frusto-conical body closed end section and the blowing free of the pressure release safety cap from the valve, Applicant further includes the hinge groove (25). The hinge groove serves to retain the fragments of the hollow frusto-conical body closed end section to the pressure release safety cap following the uncontrolled release of high pressure material within the pressure release safety cap.

Figure 6:
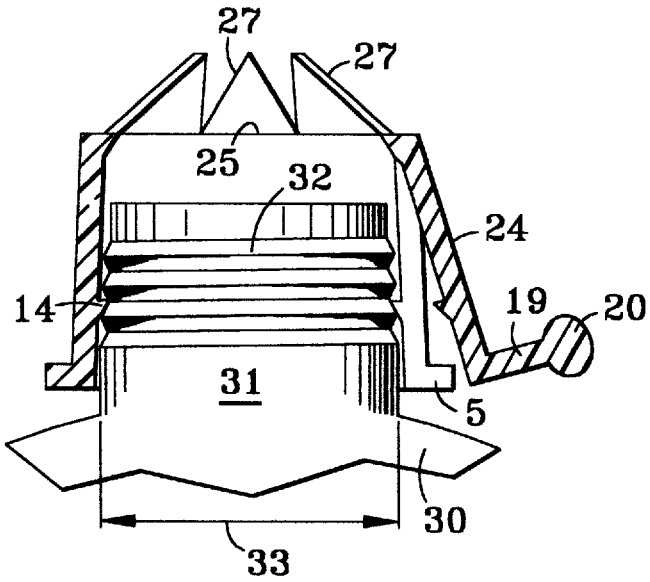
FIG. 6 is a close up cut away view of the pressure release safety cap in place on the cylinder.

As per FIGS. 1, 5 and 6, in the preferred embodiment the controlled fragmentation of the hollow frusto-conical body closed end section (3) is achieved by ensuring that frangible groove depth (28) is greater than hinge groove depth (29). The differing depths of the frangible groove depth and the hinge depth is necessary so that when the high pressure material strikes the hollow frusto-conical body closed end section inner surface (6), the hollow frusto-conical body closed end section will break apart along the frangible grooves (26), the fragments (27) separating from one another, but not breaking along the hinge groove (25). The hinge groove permits the fragments (27) to pivot outwardly, away from the valve, but at the same time ensures that the fragments remain attached to the hollow frusto-conical body closed end section, along the hinge groove. Clearly, both the frangible groove depth (28) and hinge groove depth (29) must be less than the hollow frusto-conical body closed end section thickness (11). In the preferred embodiment, as per FIG. 1, the frangible grooves (26) and the hinge groove (25) are located on the hollow frusto-conical body closed end section inner surface (6), although it is possible to locate them on the hollow frusto-conical body closed end section outer surface instead. In the preferred embodiment, the hollow frusto-conical body closed end section thickness (11) is 0.030 of one inch, the frangible groove depth (28) is 0.025 of one inch and the hinge groove depth (25) is 0.021 of one inch.

As was noted above, in the preferred embodiment, as per FIG. 5, the fragment retention means is the hinge groove (25) located on the hollow frusto-conical body closed end section (25), the hinge groove taking a geometric form having six sides. In the preferred embodiment, the hinge groove (25) is a continuous groove having no beginning or end. Although Applicant prefers the six sided geometric form as it operates optimally, it is entirely possible for the hinge groove to instead take the geometric form of a circle, a triangle, a pentagon, an octagon, or other polygon, so long as the fragments (27) have sufficient attachment to the frusto-conical body closed end section (25) to remain attached to the safety cap following the breaking of the frangible grooves (26) during the release of high pressure material from the valve.

Additionally, while a total of six frangible grooves radiating outwardly from a center point (34) and intersecting and terminating at the hinge groove (25) have been disclosed in the preferred embodiment, Applicant believes the invention may still be practiced with one or more frangible grooves, so long as the frangible grooves, when broken, permit the formation of the fragments (27) which may be urged away from the valve by the escaping high pressure material during the discharge of high pressure material from the valve (31).

It is imperative that the material from which the pressure release safety cap is made has physical properties which permit the frangible grooves (26) to break when exposed to the force applied by the escaping high pressure material, separating the fragments (27) from one another, while at the same time permitting the fragments (27) to pivot outwardly from the valve, along the hinge groove (25), thereby ensuring that the fragments remain connected to the pressure release safety cap and do not themselves become high velocity projectiles. Furthermore, the material from which the pressure release safety cap is made must have physical properties which permit the frusto-conical body wall (2) to yield slightly outwardly (transaxially) as the valve enters the pressure release safety cap and engages the circumferential retainer ridge (14) as described below. In the preferred embodiment, Applicant has chosen to fabricate the pressure release safety cap from polyethylene. While Applicant has chosen to utilize injection molded polyethylene for fabrication of the pressure release safety cap, any material which has the physical properties described above will do equally well.

It will be immediately apparent to those familiar with the art that etching, grooving or striating the closed end of the pressure release safety cap are not the only ways in which one may accomplish the objects of Applicant's invention. Clearly, one may just as easily weaken the closed end section by creating a thinner section along pressure release means and the fragment retention means during the production of the pressure release safety cap by, for example, using a mold and molding technique to produce the desired cap thicknesses which will result in frangible areas (pressure release means) and areas which act as a hinge (fragment retention means). Just as obviously, one may create weakened areas on the pressure release safety cap through the application of heat, use of chemicals which tend to weaken the material from which the pressure release safety cap is fabricated, or, in the case of certain plastics, even the application of electricity or light of certain wave lengths (ultra violet, for example) during and/or after the molding process. Certainly one could also use, for example, a sharpened instrument to substitute individual small holes in place of a continuous groove and still achieve the same result sought by Applicant. Applicant believes that the best mode for practicing his invention would utilize a frangible groove as the pressure release means and a hinge groove as the fragment retention means. However, Applicant understands, as will those familiar with the pertinent art, that the pressure release safety cap may be fabricated from a wide variety of materials having differing material properties, and that the pressure release means and the fragment retention means may be accomplished by a wide variety of techniques using a wide variety of tools and materials. The frangible groove and the hinge groove have merely been described in detail in order to enable one skilled in the art to practice the instant invention without undue experimentation and are in no way presented as limiting examples. Applicant believes that there are a great multiplicity of ways to practice his invention and that each will perform adequately so long as the pressure release safety cap is fabricated so as to permit the escape of high pressure materials from within the cap by passing through pressure release means, and so long as any and all fragments created during such a discharge are retained by the fragment retention means.

In a second embodiment of the instant invention, Applicant modifies the geometric pattern of the pressure release means and the fragment retention means as originally presented in the preferred embodiment so as to produce a pressure release safety cap having a single fragment rather than multiple fragments. As per FIG. 7, utilizing the same frusto-conical body as disclosed above, Applicant again utilizes pressure release means and fragment retention means comprising the frangible groove and the hinge groove, respectively. In the second embodiment, the pressure release means is a single frangible groove (35) on the frusto-conical body closed end section (3). The fragment retention means is a single hinge groove (36) on the frusto-conical body closed end section (3). Applicant prefers that the single frangible groove (35) and the single hinge groove (36) are located on the frusto-conical body closed end section inner surface (6) rather than the outer surface (7), although this is not necessary for the operation of the second embodiment.

Furthermore, in the second embodiment, the single frangible groove (35) is in the shape of an incomplete circle, and the single hinge groove (36) is in the shape of a straight line which completes the circle, resulting in a pressure release means which appears to be a circle with a straight section. Applicant prefers the single frangible groove (35) and the single hinge groove (36) to both be located on the frusto-conical body closed end section inner surface (6), however in both the second embodiment and the preferred embodiment, it is entirely possible to have the pressure retention means and the fragment retention means both located on the inner surface (6) or the outer surface (7) or even to have the pressure retention means and the fragment retention means on opposite surfaces of the closed end section.

Figure 7:
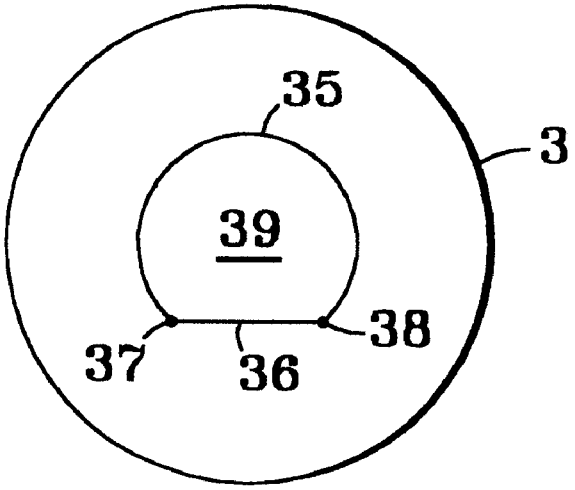
FIG. 7 is a plan view of a second embodiment of the pressure release safety cap.

The geometric form of the second embodiment of the instant invention may be better understood with reference to FIG. 7 wherein the pressure release safety cap closed end section inner surface is disclosed. In the second embodiment of the instant invention, the single frangible groove (35) begins at a first point (37) and continues in an arc to a second point (38). Applicant has noted above that the single frangible groove appears as an incomplete circle. That incomplete circle includes approximately 300 degrees of arc. The single hinge groove, in turn, begins at the second point (38) and continues in the form of a straight line where it meets and merges into the first point (37). Thus, the second embodiment appears in the form of an circle having a flattened area. The area which is peripherally defined by the single hinge groove and the single frangible groove may be referred to as the single fragment (39).

As with the preferred embodiment of the instant invention, the pressure release means is weaker than the fragment retention means. As was noted above in the preferred embodiment, the relative weakness of the pressure release means and the fragment retention means may be accomplished in a wide variety of ways. In the second embodiment of the instant invention, this is accomplished by fabricating the pressure release safety cap such that the single frangible groove (35) should have a depth which is greater than a depth of the single hinge groove (36). As with the preferred embodiment, Applicant believes that the precise dimensions of the single pressure release means and the single fragment retention means is variable and dependent upon the material from which the pressure release safety cap is formed, and the dimensions of the safety cap itself. However, in the second embodiment, Applicant prefers the depth of the single frangible groove to be greater than the depth of the single hinge groove in the second embodiment of the instant invention for the same reasons expressed in the preferred embodiment; to wit, that the single frangible groove should be of sufficient depth so that the frusto-conical body closed end section (3) is structurally weakened by the single frangible groove sufficiently to permit the frusto-conical body closed end section, once the cap is in place on the valve, and during an unexpected discharge of high pressure material, to break apart along the single frangible groove and permit the high pressure material to exit from within the cap, while at the same time ensuring that the frusto-conical body closed end section is still sufficiently structurally sound along the single hinge groove to maintain the portion of the frusto-conical body closed end which is peripherally defined by the single frangible groove and the single hinge groove to remain attached to the pressure release safety cap and thus prevent the portion of the frusto-conical body closed end which is peripherally defined by the single frangible groove and the single hinge groove from becoming completely detached from the pressure release safety cap and thereby prevent the portion of the frusto-conical body closed end which is peripherally defined by the single frangible groove and the single hinge groove from acting as a high pressure projectile.

Finally, Applicant would point out that while the pressure release safety cap has been consistently described as having a frusto-conical shape, that shape is not required in order for the instant invention to operate. In fact, one might just as easily utilize a truncated cylinder rather than a truncated cone. Or one might choose to utilize a cuboidal or spherical shape. Nearly any shape will function, so long as it has a hollow interior for the insertion therein of the valve, has a means for retaining the pressure release safety cap to the valve, and has a surface proximate to the opening in the valve on which may be located the pressure release means and the fragment retention means so that in the event an unexpected discharge of high pressure material took place, the pressure release safety cap would remain in place and would vent the high pressure material without allowing pressure release safety cap fragments to brake free of the pressure release safety cap and act as projectiles. Applicant believes that the best mode for practicing his invention will utilize a pressure release safety cap having a frusto-conical shape, but he further believes that many other geometric shapes for that cap may work equally well. Applicant discloses the instant invention as frusto-conical in form merely to permit those skilled in the art to practice the instant invention without resorting to undue experimentation, not as a limiting example.

The operation of the preferred embodiment of Applicant's pressure release safety cap may now be completely understood. As per FIG. 6, the pressure release safety cap is attached to a container (30) having highly pressurized contents by aligning the hollow frusto-conical body open end (4) over the valve (31). The pressure release safety cap is then pressed onto the valve (31) the valve thereby being inserted into the pressure release safety cap, the valve entering the hollow frusto-conical body open end (4). The user of the device then secures the pressure release safety cap to the valve (31) by pressing the pressure release safety cap downwardly, that is, pressing on the pressure release safety cap such that the circumferential flange (5) moves toward the container (30) and the hollow frusto-conical body closed end section inner surface (6) moves toward the valve (31). Obviously, if a pressure safety cap is utilized which does not have a circumferential flange, such pressure release safety cap would be secured to the valve in another manner (by, for example, a single use security strap of the sort well known in the art).

The user of the instant invention continues to press downwardly on the pressure release safety cap so that the circumferential retainer ridge angled section (16) comes into contact with the valve threads (32). Clearly, the hollow frusto-conical body interior diameter (12) must be as large as a valve diameter (33). It will be remembered that the circumferential retainer ridge (14) extends outwardly, away from the frusto-conical body wall (2). Therefore, as the circumferential retainer ridge (14) engages the threads (32) while the user of the instant invention presses downwardly on the pressure release safety cap, the frusto-conical body wall (2) will be urged slightly outwardly, the valve threads (32) moving along the circumferential retainer ridge angled section (16) which acts essentially as a form of inclined plane. After the circumferential retainer ridge passes over the highest point of the thread, the circumferential retainer ridge will be urged back into its original position by the resilient frusto-conical body wall (the body wall acting essentially as a biasing means, tending to urge the circumferential retainer ridge inwardly, toward the valve), the circumferential retainer ridge lodging in the lowest point between the ridges. Those skilled in the art will immediately recognize that this form of attachment of a safety cap to a cylinder valve is well known.

Once attached to the valve (31) the pressure release safety cap is useful for preventing the unwanted intrusion of foreign matter into the valve. The circumferential flange (5) should be in contact with the cylinder (30), thus preventing intrusion under the safety cap.

Transportation and storage of the cylinder may now take place. However, as is also well known in the industry, it is entirely possible that there may be an uncontrolled and unanticipated escape of high pressure material from within the cylinder during that transportation and or storage. The benefit of Applicant's novel pressure release safety cap will now become readily apparent.

Should such an uncontrolled and unanticipated release of high pressure material from the valve (31) take place, the pressure release safety cap will operate to vent that material rather than permitting the safety cap to become a potentially dangerous projectile. In the event that a discharge takes place, the high pressure material will be released against the frusto-conical body closed end section inner surface (6). The application of said high pressure material to the frusto-conical body closed end section inner surface will tend to force that surface away from the valve (31). However, because the pressure release safety cap is firmly attached to the valve (31) by the pressure release safety cap retention means (the circumferential retainer ridge in the preferred embodiment) (14), the pressure will not be able to escape by dislodging the pressure release safety cap, as would occur with safety caps known in the prior art. Instead, the pressure against the frusto-conical body closed end section inner surface (6) will tend to force the fragments (27) apart from one another along the frangible grooves (26). That is, the pressure release means (frangible grooves in the preferred embodiment) will tend to break, the frusto-conical body closed end section (3) being weakened along those frangible grooves.

Next, with the frangible grooves (26) having broken, the fragments (27) will tend to be forced upwardly and outwardly, away from the valve (31) and the cylinder (30) due to the application of force to the fragments by the escaping high pressure material. Furthermore, because the frusto-conical body closed end section has also been weakened along the fragment retention means (the hinge groove (25) in the preferred embodiment), the fragments (27) will be more easily urged away from the valve (31), the hinge groove acting essentially as a hinge and fragment retainer on the frusto-conical body closed end section (3). It should be remembered at this point that the hinge groove depth (29) is less than the frangible grooves depth (28). Therefore, as the frangible grooves (26) break apart, permitting the fragments (27) to move away from the valve and providing a larger high pressure release area through which the high pressure material will escape, the fragments (27) will remain secured to the pressure release safety cap, the hinge grooves essentially bending rather than breaking, thereby retaining the fragments as part of the safety cap and preventing them from becoming potentially dangerous projectiles.

As per FIGS. 2 and 6, irrespective of whether the pressure release safety cap has been subjected to the unanticipated and uncontrolled escape of high pressure material from the valve, said pressure release safety cap will be removed from the cylinder eventually by the user of the cylinder. Removal is accomplished by gripping the pull tab (19) and pulling said tab outwardly and upwardly, away from cylinder (30). This causes the circumferential flange (5) to break along the parallel weakened lines (21), splitting the circumferential flange (should same be utilized). Continuing to pull on the tab then causes the frusto-conical body wall (2) to break apart along the parallel weakened lines (21), splitting the frusto-conical body wall. The circumferential flange (5) and the frusto-conical body wall (2) having been split open, the pressure release safety cap may easily be removed from the valve, providing access to the valve. In the case of a pressure release safety cap which utilizes a single use safety strap rather than a circumferential flange to retain the pressure release safety cap to the valve, one would merely cut or break said strap and remove the safety cap.

Figure 8:
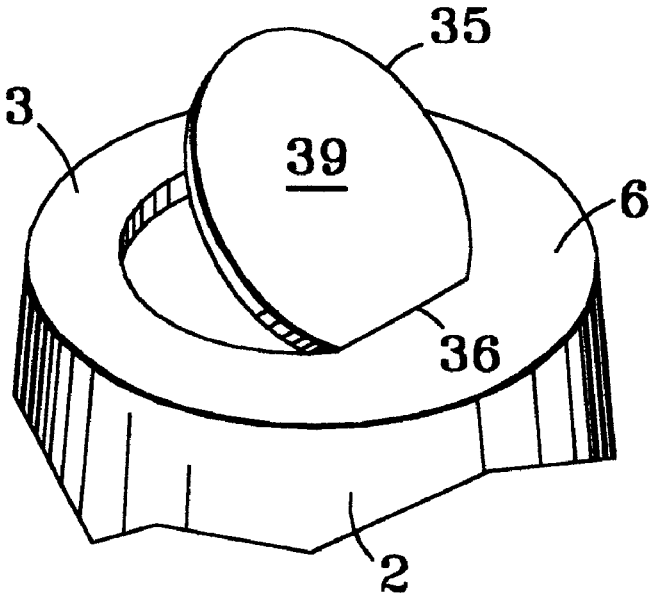
FIG. 8 is a perspective view of the second embodiment of the pressure release safety cap with the fragment pivoted outwardly.

The operation of the second embodiment of the instant invention is nearly identical to the operation of the preferred embodiment. The second embodiment is attached to the valve in the same manner as is the first embodiment. During the discharge of high pressure material, as per FIG. 8, the pressure release means (the single frangible groove (35) in the second embodiment) breaks apart from the pressure release safety cap closed end section (3) and the single fragment (39) pivots outwardly, away from the valve along the fragment retention means (the single hinge groove (36) in the second embodiment), the single fragment remaining attached to the high pressure release safety cap along the single hinge groove.

Again, it should be remembered that, as was explained with the preferred embodiment, the second embodiment of the instant invention may take a number of geometric forms. For example, the single fragment could take the form of a triangle with two of the triangle's sides acting as the single frangible groove, and the third side of the triangle acting as the single hinge groove. The diverse geometric forms which may be used shall not be individually detailed, it being sufficient to note that there must be a pressure release means and a fragment retention means.

I claim:

1. A pressure release safety cap for use on a container having pressurized contents comprising;

A. a hollow body having an open end and a closed end,
  I. the closed end having an inner surface and an outer surface,
B. a pressure release means for permitting the formation of fragments during a discharge of the pressurized contents,
  I. the pressure release means being located on the closed end,
C. a fragment retention means for permitting the fragments to be pivotally urged away from the container during the discharge of the pressurized contents,
  I. the fragments remaining attached to the closed end,
  II. the fragment retention means being located on the closed end.

2. The pressure release safety cap according to claim 1, the fragment retention means further comprising;

A. a hinge groove.

3. The pressure release safety cap according to claim 2, the pressure release means further comprising;

A. at least three frangible grooves extending radially from a center point, the center point being located on the pressure release safety cap, horizontally co-planar with the frangible grooves,
  I. the frangible grooves each having frangible groove depth,
B. the hinge groove circumferentially surrounding the center point and intersecting the frangible grooves,
  I. the hinge groove being horizontally co-planar with the frangible grooves,
  II. the hinge groove having hinge groove depth,
    a. the frangible groove depth being greater than the hinge groove depth.

4. The pressure release safety cap according to claim 1, the fragment retention means being located on the closed end outer surface.

5. The pressure release safety cap according to claim 4, the fragment retention means further comprising;

A. a hinge groove.

6. The pressure release safety cap according to claim 1, the fragment retention means being located on the closed end inner surface.

7. The pressure release safety cap according to claim 6, the fragment retention means further comprising;

A. a hinge groove.

8. The pressure release safety cap according to claim 1, the pressure release means further comprising;

A. a single frangible groove, the single frangible groove being in the form of a nearly complete circle,
  I. the single frangible groove having a beginning point and an ending point,
  II. the single frangible groove having single frangible groove depth,
B. a single hinge groove,
  I. the single hinge groove being in the form of a straight line,
  II. the single hinge groove extending from the single frangible groove beginning point to the single frangible groove ending point,
  III. the single hinge groove being horizontally co-planar with the single frangible groove, IV. the single hinge groove having single hinge groove depth, a. the single frangible groove depth being greater than the single hinge groove depth.

9. A pressure release safety cap for use on a container having pressurized contents comprising;

A. a hollow body having an open end and a closed end,

I. the closed end having an inner surface and an outer surface,

B. a pressure release means located on the hollow body closed end,

I. the pressure release means permitting the formation of fragments during a discharge of the pressurized contents, C. a fragment retention means located on the hollow body closed end, I. the fragment retention means being a structurally weakened area of the closed end, II. the fragment retention means permitting the fragments to be pivotally urged away from the container during a discharge of the pressurized contents.

* * * * *